US008240514B2

(12) United States Patent
Livingston et al.

(10) Patent No.: US 8,240,514 B2
(45) Date of Patent: Aug. 14, 2012

(54) POWDERED AND LIQUID CHEMICAL DISPENSING AND DISTRIBUTION SYSTEM

(75) Inventors: James W. Livingston, Manton, CA (US); Michael A. Steed, Santa Cruz, CA (US); Scott D. E. Alhart, Soquel, CA (US)

(73) Assignee: Diversey, Inc., Sturtevant, WI (US)

( * ) Notice: Subject to any disclaimer, the term of this patent is extended or adjusted under 35 U.S.C. 154(b) by 595 days.

(21) Appl. No.: 12/293,745

(22) PCT Filed: Mar. 16, 2007

(86) PCT No.: PCT/US2007/064200

§ 371 (c)(1),
(2), (4) Date: Sep. 19, 2008

(87) PCT Pub. No.: WO2007/146458

PCT Pub. Date: Dec. 21, 2007

(65) Prior Publication Data

US 2010/0237169 A1 Sep. 23, 2010

Related U.S. Application Data

(60) Provisional application No. 60/787,583, filed on Mar. 30, 2006.

(51) Int. Cl.
*B67D 5/60* (2006.01)

(52) U.S. Cl. ..... 222/145.5; 222/145.2; 222/135; 222/651; 68/17 R

(58) Field of Classification Search ..... 239/148; 222/145.1, 145.2, 145.5, 129.3, 129.4; 134/100.1, 134/102.1, 102.2; 68/17 R
See application file for complete search history.

(56) References Cited

U.S. PATENT DOCUMENTS

| | | | | |
|---|---|---|---|---|
| 3,570,717 | A | 3/1971 | Olson | |
| 4,071,377 | A * | 1/1978 | Schwuger et al. | 134/29 |
| 6,691,536 | B2 * | 2/2004 | Severns et al. | 68/12.27 |
| 6,826,933 | B2 * | 12/2004 | Merkle et al. | 68/17 R |
| 6,880,191 | B2 * | 4/2005 | Bristor | 8/148 |
| 2005/0183208 | A1 * | 8/2005 | Scheper et al. | 8/142 |
| 2005/0229652 | A1 * | 10/2005 | Kim et al. | 68/237 |
| 2006/0107705 | A1 * | 5/2006 | Hsu et al. | 68/17 R |

FOREIGN PATENT DOCUMENTS

| | | |
|---|---|---|
| DE | 10103091 | 8/2002 |
| GB | 2348709 | 10/2000 |
| WO | 2005/068060 | 7/2005 |

OTHER PUBLICATIONS

International Search Report from the European Patent Office.

* cited by examiner

*Primary Examiner* — Dinh Q Nguyen
(74) *Attorney, Agent, or Firm* — Gregory S. Bollis

(57) ABSTRACT

The chemical distribution system (100) includes at least a first chamber that is fluidly coupled to a second chamber below it, which is in turn fluidly coupled to a manifold below it. In use, water and a powdered chemical are introduced into the first chamber. Liquid chemicals, however, are injected into the second chamber through multiple chemicals inlets in the second chamber. A pressure sensor fluidly coupled to the first chamber is used to accurately measure dosages of the liquid chemical. Once the accurate dosages have been determined, the powdered and/or liquid chemicals are distributed through one of multiple manifold outlets and along a single line (116(*a*), 116(*b*)) to one of multiple washing machines (102(*a*), 102(*b*)).

20 Claims, 6 Drawing Sheets

POWDERED AND LIQUID CHEMICAL DISPENSING AND DISTRIBUTION SYSTEM

TECHNICAL FIELD

The embodiments disclosed herein relate to chemical distribution systems and in particular to a system and method for dispensing and distributing liquid and powdered chemicals to washers.

BACKGROUND

Many industries require the frequent use of accurate dosages of chemicals. These industries include the on premise laundry (OPL) and machine ware wash (MWW) industries, where large volumes of chemicals are used daily. As these chemicals are consumed, new chemicals must be shipped to the user and distributed to their eventual point of use, such as to washing machines ("washers").

Typically, automated chemical distribution systems distribute liquid chemicals, as it is relatively easy to distribute liquids, as compared to non-liquids like powder, to their eventual point of use. However, transporting liquid chemicals to the end user presents a number of drawbacks. For example, liquid chemicals occupy a large volume, are heavy, and, therefore, are expensive to ship and transport to the end user. Furthermore, certain chemicals are more easily manufactured and stored as a non-liquid form, e.g., a powder, and, therefore, manufacturing and shipping these chemicals in a liquid form increases the complexity and cost, and decreases the usability, of such liquid chemicals.

On the other hand, non-liquid chemicals, e.g., powders, are easier to store and ship. Non-liquid chemicals are also generally less complex and expensive to manufacture. However, a non-liquid chemical is not easy to automatically distribute to its eventual point of use. However, those few automated chemical distribution systems that distribute powdered chemicals require separate automated chemical distribution systems for liquid chemical distribution. In other words, existing automated chemical distribution systems that distribute liquid chemicals to their point of use are not compatible with powdered chemicals. Such duplication of automated chemical systems substantially increases the overall complexity and cost of automatically distributing chemicals to their points of use.

In light of the above, it would be highly desirable to provide a single chemical distribution system that can distribute accurately dosages of both liquid and powdered chemicals.

SUMMARY

According to some embodiments there is provided a powdered and liquid chemical distribution system that includes first, second and third chambers and a manifold. The first chamber is defined by at least one first chamber wall, and includes first and second ends and a port. The first chamber first end is configured to receive water and one or more powdered chemicals into the first chamber, while the first chamber second end is opposite the first chamber first end. The port is formed in the at least one first chamber wall, and is configured to be coupled to a sensor. The second chamber is defined by at least one second chamber wall and also includes first and second ends. The second chamber first end is fluidly coupled to the first chamber second end, while the second chamber second end is opposite the second chamber first end. One or more liquid chemical inlets are formed in the at least one second chamber wall, where each of the liquid chemical inlets is configured to be coupled to a different liquid chemical source. The manifold includes a manifold inlet fluidly coupled to the second chamber second end, and one or more manifold outlets each configured to be coupled to a different device.

According to some other embodiments there is provided a powdered and liquid chemical distribution system that includes a transport chamber, a measuring chamber, a chemical chamber and a manifold. The transport chamber includes a transport chamber first end configured to receive water and a at least one powdered chemical into the transport chamber. The transport chamber also includes a transport chamber second end opposite the transport chamber first end. The measuring chamber includes a measuring chamber first end fluidly coupled to the transport chamber second end, and a measuring chamber second end opposite the measuring chamber first end. A port is formed in the measuring chamber between the measuring chamber first end and the measuring chamber second end. The port is configured to be coupled to a level sensor. The chemical chamber includes a chemical chamber first end fluidly coupled to the measuring chamber second end, and a chemical chamber second end opposite the chemical chamber first end. The chemical chamber also includes at least one liquid chemical inlet for receiving a liquid chemical into the chemical chamber. Finally, the manifold includes a manifold inlet fluidly coupled to the chemical chamber second end, and at least one manifold outlet configured to be coupled to at least one washer.

According to yet other embodiments there is provided a chemical distribution system that includes first and second chambers and a manifold. The first chamber defined by at least one first chamber wall. The first chamber includes a first chamber first end configured to receive water into the first chamber, and a first chamber second end opposite the first chamber first end. A port is formed in the at least one first chamber wall. The port is configured to be coupled to a sensor. The second chamber is defined by at least one second chamber wail. The second chamber includes a second chamber first end fluidly coupled to the first chamber second end, and a second chamber second end opposite the second chamber first end. One or more chemical inlets are formed in the at least one second chamber wall. Each of the chemical inlets is configured to be coupled to a different chemical source. The manifold includes a manifold inlet fluidly coupled to the second chamber second end, and one or more manifold outlets each configured to be coupled to a different device.

According to some embodiments there is provided a method for distributing powdered and liquid chemicals. Water is introduced into an upper end of a measuring chamber. A liquid chemical is then injected into a chemical chamber that is fluidly coupled to a lower end of the measuring chamber until a desired volume of the liquid chemical has been introduced. The desired volume of liquid chemical and at least some of the water is pumped to a washer. Water and a desired dose of a powdered chemical may then be inserted into the upper end of the measuring chamber, and thereafter transported to the washer.

According to some other embodiments there is provided a method for distributing powdered and liquid chemicals. Water is introduced into an upper end of a chamber. A desired volume of liquid chemical is injected into a bottom end of the chamber. The desired volume of liquid chemical and at least some of the water is then pumped to one washer of multiple washers. A desired dose of a powdered chemical and water then introduced into an upper end of the chamber. The powdered chemical and at least some of the water is subsequently pumped to the one washer.

In many of these various systems and methods flow of liquid is achieved with gravity feed only, where each subsequent lower chamber or tubing has a smaller size or diameter than the chamber above it. Not only does this keep liquid chemicals, powdered chemicals, and/or other chemicals from sticking to the walls of the system (which can damage the system or cause harmful chemical reactions within the system), the downsizing of chambers, and or tubing, produces a higher velocity at the exit point to help clean out or flush the system of chemicals. Also, the system is continually flushed with water before, during and after the liquid or powdered chemicals are introduced into the system. This also helps to keep the unit clean and free of harmful residue.

Accordingly, the above described systems and methods provide a single chemical distribution system and method, whereby accurate dosages of both liquid and powdered chemicals can be distributed along a single line to each of multiple washers.

BRIEF DESCRIPTION OF THE DRAWINGS

For a better understanding of the nature and objects of the invention, reference should be made to the following detailed description taken in conjunction with the accompanying drawings, in which.

Like reference numerals refer to the same or similar components throughout the several views of the drawings.

DETAILED DESCRIPTION OF THE EMBODIMENTS

The following describes various embodiments of chemical distribution systems and methods. These systems are particularly well suited for on premise laundry (OPL) and machine ware wash (MWW) applications. However, it should be appreciated that the systems and methods described herein may be used for any suitable chemical distribution applications.

Figure 1:
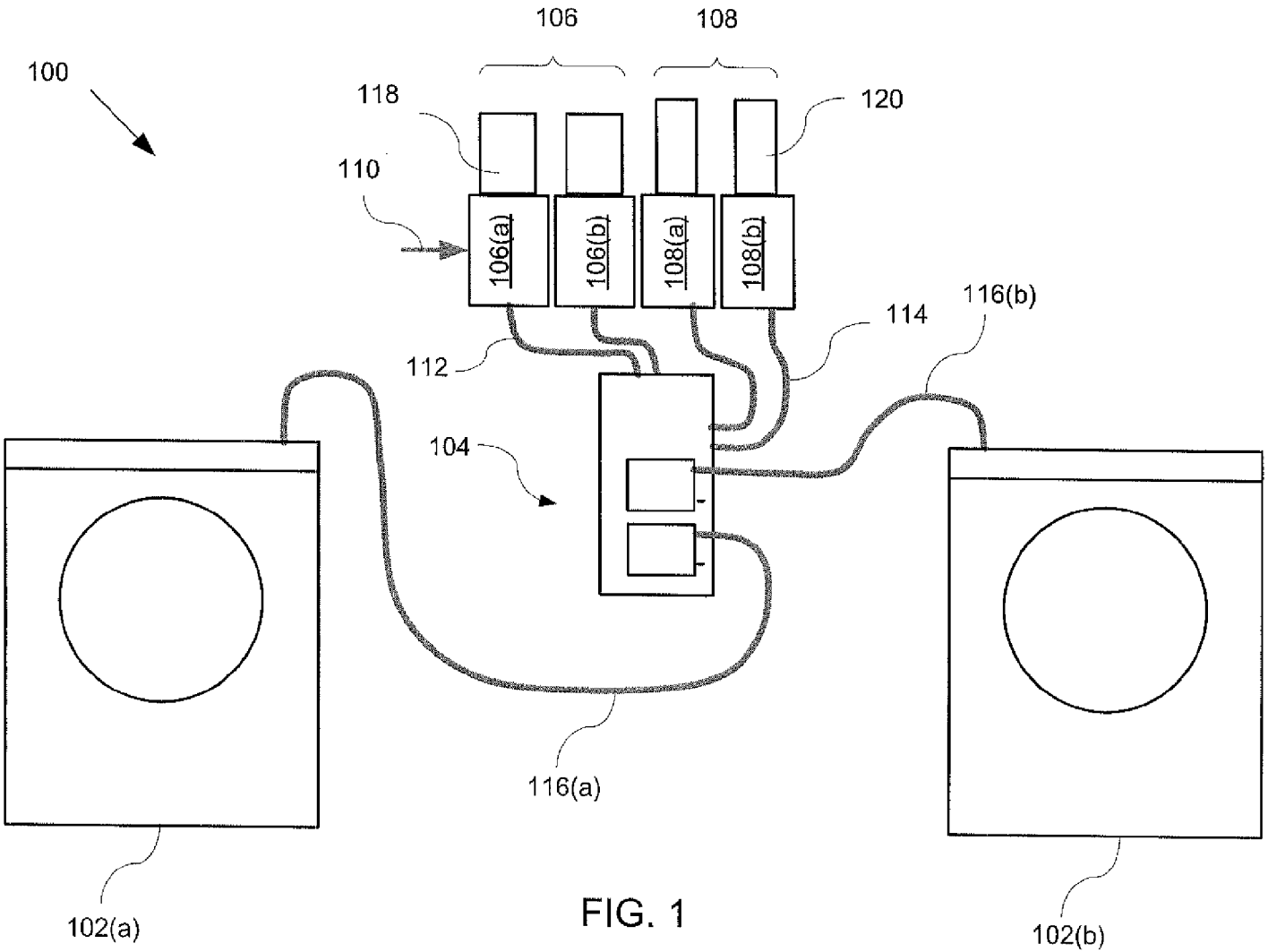
FIG. 1 is a block diagram of a powdered and liquid chemical distribution system, according to an embodiment of the invention.

FIG. 1 is a block diagram of a powdered and liquid chemical distribution system 100. The system 100 includes a chemical distribution hub 104 (sometimes referred to as a transport module) that dispenses and/or distributes water and one or more chemicals to devices, such as washers 102(*a*) and 102 (*b*), along tubes or lines 116. In some embodiments, only a single tube or line is run to each device, unlike current systems which typically require more than one line to each device, as will be explained in further detail below.

Water is supplied from one or more water sources 110, such as a municipal or city water supply. One or more powdered chemicals may be provided by one or more powdered chemical sources 106 that are coupled to the hub 104 via one or more tubes or lines 112. In some embodiments, the water from the water source 110 is also provided to the hub 104 along the same lines 112 that supply the powdered chemical(s). Also in some embodiments, the powdered chemical sources receive disposable powdered chemical refill containers 118. A suitable powdered chemical source and/or container is disclosed in Applicant's US Patent Publication No. US 2005/0247742A1 entitled "Metering and Dispensing Closure," the entire contents of which is incorporated herein by reference.

In addition, one or more liquid chemicals may be provided by one or more liquid chemical sources 108 that are coupled to the hub 104 via one or more tubes or lines 114. In some embodiments, the powdered chemical sources receive disposable liquid chemical refill containers 120. In other embodiments, one or more liquid chemicals may be supplied from a tank that is refilled, or the like.

Figure 2:
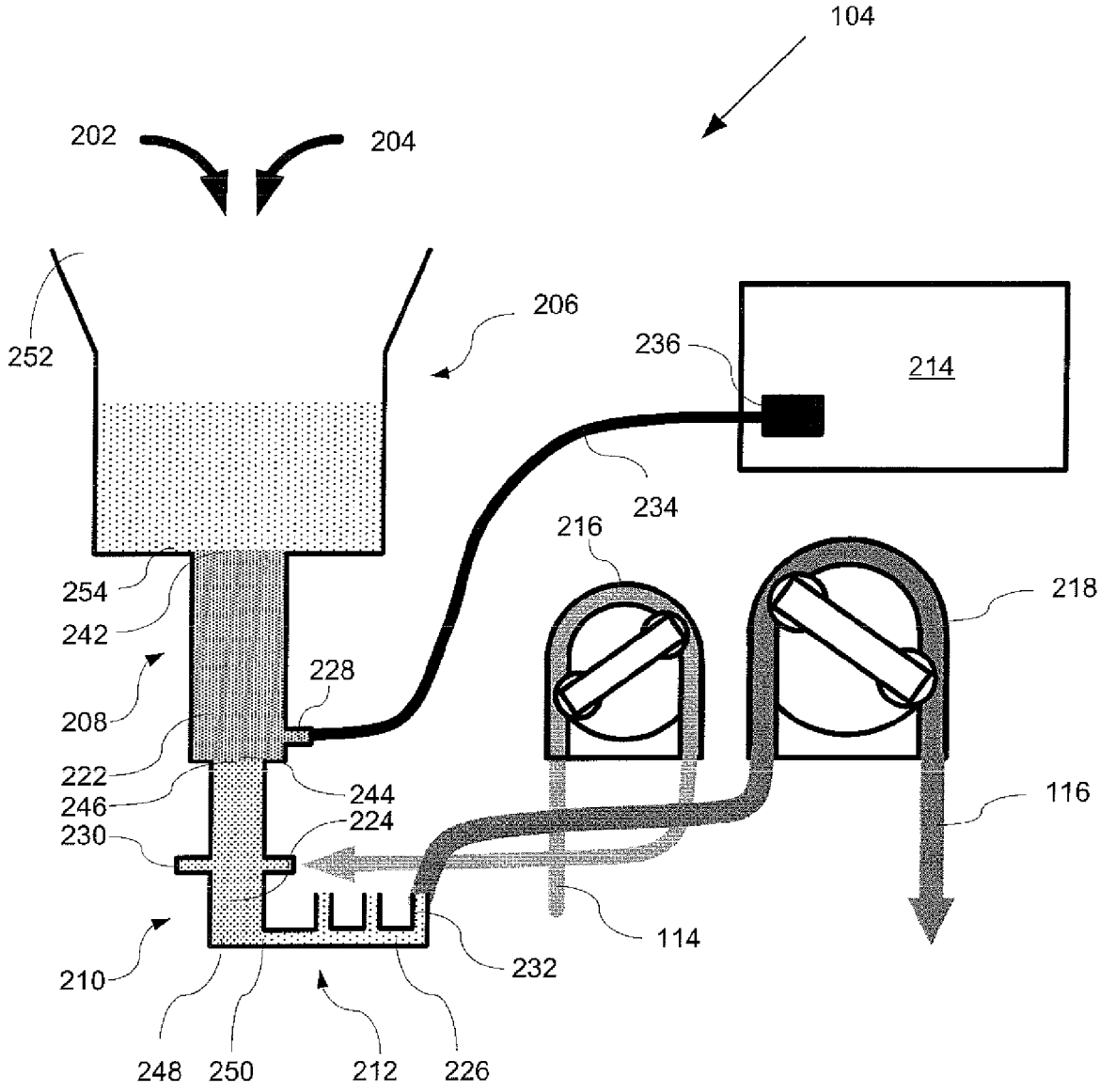
FIG. 2 is a partial cross-sectional view of the chemical distribution hub of the chemical distribution system shown in FIG. 1.

FIG. 2 is a partial cross-sectional view of the chemical distribution hub 104 of the chemical distribution system 100 shown in FIG. 1. In some embodiments, the hub 104 includes three chambers. It should however be appreciated that more or less chambers may be used. The three chambers include a measuring chamber ("first chamber") 208, a chemical chamber ("second chamber") 210, and a transport chamber ("third chamber") 206. In some embodiments, the three chambers are aligned with one another in use so that the third chamber 206 is disposed vertically above the first chamber 208, and the first chamber 208 is disposed vertically above the second chamber 210, i.e., aligned along a vertical line that is perpendicular to the horizon. In some embodiments, the three chambers are aligned with one another such that fluid can flow under a gravitational force from the third chamber 206 to the first chamber 208, and from the first chamber 208 to the second chamber 210.

The first chamber 208 is defined by at least one first chamber wall. In some embodiments the first chamber wall is a circular wall that defines a cylinder having a first diameter D1. The volume of the chamber is selected such that any change in fluid level in the chamber is great enough to allow easy sensing of the change in pressure by a sensor, described below, while retaining the water volume low enough to allow rapid flushing at the end of a dose cycle. A suitable range of first diameters and heights of the first chamber are 0.5-2 inches and 4 to 10 inches, respectively. The first chamber 208 has a first chamber first end 242, an opposing first chamber second end 244, and a port 228. The first chamber first end 242 is configured to receive into the first chamber 208: (i) water 202, from a water source 110 (FIG. 1), and/or (ii) one or more powdered chemicals 204, from one or more powdered chemical sources 106 (FIG. 1). The port 228 is formed in the first chamber wall. In some embodiments, the port 228 is situated near the first chamber second end 244. Also in some embodiments, the port has a diameter that is significantly larger than the pressure sensor input tube to create a trapped air pocket between the chamber and the pressure sensor input tube. Also in some embodiments, the diameter of the port 228 is chosen so that water is not drawn or held in the port by a capillary action. In some embodiments, the height of the first chamber that is used for calibration is in the range of 2 to 6 inches above the port 228.

The port 228 allows fluid communication into the first chamber 208. The port 228 is configured to be coupled to a sensor 236. In some embodiments, the sensor 236 is a pressure sensor, such as an absolute pressure sensor, that measures the head of fluid in the first chamber 208 above the port 228. In some embodiments, the sensor 236 is disposed within a controller 214. The controller 214 is configured to calibrate the chemical distribution system, control the flow of water and chemicals into the hub 104, and control the flow of water and chemicals to the various devices 102 (FIG. 1), as described in further detail below.

The second chamber 210 is defined by at least one second chamber wall. In some embodiments the second chamber wall is a circular wall that defines a cylinder having a second diameter D2. In some embodiments, the first diameter D1, i.e., the diameter of the first chamber is larger than the second diameter D2, i.e., the diameter of the second chamber. The second diameter is chosen to be large enough to allow liquid chemicals to be injected into the second chamber, but small enough to facilitate high velocities of water to flush any liquid chemical residue from the second chamber. A suitable range second diameters and heights of the second chamber are 0.25 to 1.75 inches and 5 to 11 inches, respectively. The second chamber 210 has a second chamber first end 246, an opposing second chamber second end 248, and one or more chemical inlets 230 in the at least one second chamber wall. The second chamber first end 246 is configured to be coupled to the first chamber second end 244. Each of the one or more chemical inlets 246 allows fluid communication into the second chamber 210. In some embodiments, each of the chemical inlets is configured to be coupled to a different liquid chemical source 108 (FIG. 1). Where multiple chemical inlets are provided, but fewer chemical sources are provided, the additional inlets may be capped. Each chemical inlet 230 coupled to a chemical source, is coupled to a tube or line 114, such as a flexible plastic tube, that is coupled to the chemical source. In some embodiments, each of these chemical inlets 230 is coupled to a respective chemical source via a chemical pump 216, as shown. For example, a flexible plastic tube transporting a liquid chemical may be inserted through a positive displacement pump, such as a peristaltic pump. In some embodiments, each chemical pump 216 is located within a respective liquid chemical source 108.

The manifold 212 has a manifold inlet 250 fluidly coupled to the second chamber second end 248. In some embodiments, the manifold may be coupled to the second chamber second end via a tube or line (see FIG. 6). The manifold also includes one or more manifold outlets 232 each configured to be coupled to a different device 102 (FIG. 1). Where multiple manifold outlets 232 are provided, but fewer devices are provided, the additional outlets may be capped. Each manifold outlet 232 coupled to a device, is coupled to a tube or line 116, such as a flexible plastic tube, that is coupled to the chemical source. In some embodiments, each of these manifold outlets 232 is coupled to a respective device via a transport pump 218, as shown. For example, a flexible plastic tube transporting water and a chemical to a device may be inserted through a positive displacement pump, such as a peristaltic pump.

The third chamber 206 is defined by at least one third chamber wall. In some embodiments the third chamber wall is a circular wall that defines a cylinder having a third diameter D3. Also in some embodiments, the third diameter D3, i.e., the diameter of the third chamber is larger than the first diameter D1, i.e., the diameter of the first chamber. The third chamber 206 has a larger diameter to facilitate larger volumes of, particularly of water, to be transported once calibration has taken place. The larger diameter also provides an overflow volume in case of failure of the sensor 236, i.e., if the sensor fails, the water entering the third chamber can rise without overflowing until the flow of water is automatically stopped by the controller after a predetermined time period. A suitable range of third diameters are 3 to 7 inches. The third chamber 206 includes a third chamber first end 252 and a third chamber second end 254. The third chamber first end 252 is configured to receive water 202 and chemicals 204 into the third chamber 206. For example, water 202 is received from at least one water source 110 (FIG. 1) and one or more powdered chemical(s) 204 are received from the powdered chemical source(s) 106 (FIG. 1). The third chamber second end 254 is located opposite the third chamber first end 252. The third chamber second end 254 is fluidly coupled to the first chamber first end 242.

In use, the chemical distribution system may first be initialized to: ensure that the water level is known and ready for feed or distribution, to measure sensor offset, and to compensate for drift of the sensor output. First, the controller 214 may verify communication with the remote chemical sources, valves, pumps, etc. One or more of the transport pump(s) 218 are then run until the sensor 236 measures that the level in the first chamber has stopped dropping, i.e., the fluid in the first chamber has dropped below the port 228. The controller then records the sensor output as zero offset, which is used to adjust all readings during feed or distribution to the devices. If the sensor continues to report that the level is dropping after a predetermined time period, then an error exists and the user is notified.

Next, the system checks that the transport pump and water supply are operational before starting to pump chemicals. The water supply 110 (FIG. 1) is turned on and the system waits for the level to rise above the sensor to a predetermined level. One or more of the transport pumps 218 are then turned on and the controller 214 waits for the level in the first chamber 208 to drop to just above the port 228. At that time, the transport pump is turned off.

To dispense a liquid chemical, all flow out of the manifold is stopped, e.g., pumps 216 and 218 are turned off. If water is not already present in the first chamber, then water is injected from the water source 110 (FIG. 1) into the third chamber 206. The water flows into the first chamber 208 and is filled to a level just above the port 228.

The chemical(s) to be dispensed (typically a liquid chemical) are introduced into the second chamber 210 via one or more of the chemical inlets 230. This may be accomplished by turning on the chemical pump(s) 216. The entry of the chemical(s) into the second chamber 210 causes the water in the first chamber 208 to rise. The resulting change in water level in the first chamber is detected by the sensor 236, i.e., the sensor detects the change in head (pressure) in the first chamber. As the volume of the first chamber is known, the increase in pressure is used to determine the volume of chemical(s) being injected. When the desired volume has been reached, flow of the chemical(s) into the second chamber 210 is stopped, e.g., the chemical pump(s) 216 are turned off by the controller 214. The chemical(s) and water are then distributed to a desired device 102 (FIG. 1). This may be accomplished by, for example, turning on one of the transport pumps 218 for a predetermined amount of time sufficient to pump the chemical(s) and water to a desired device 102 (FIG. 1). The water that follows the chemical(s) to the device has the added advantage of flushing the chemical distribution system of the chemical(s).

Where larger dosages of liquid chemicals are to be dispensed and distributed, the chemical to be dispensed (typically a liquid chemical) is introduced into the second chamber 210 via one or more of the chemical inlets 230. This may be accomplished by turning on the chemical pump 216. The entry of the chemical into the second chamber 210 causes the water in the first chamber 208 to rise. The resulting change in water level in the first chamber is detected by the sensor 236, i.e., the sensor detects the change in head (pressure) in the first chamber. As the volume of the first chamber is known, the increase in pressure is used to determine the volume of chemical being injected. When a predetermined volume has been injected, flow of the chemical into the second chamber 210 is stopped by the controller 214 turning off the chemical pump 216. The controller 214 also measures the time that it takes the chemical pump 216 to inject the predetermined volume. The controller 14 uses the predetermined volume and the measured time to determine the flow rate of the liquid chemical being injected by the chemical pump 216. Using this calculated flow rate, the controller turns on the chemical pump 216, a flow of water, and the transport pump 218 until the larger dosages of liquid chemical has been dispensed and distributed. During this dispensing and distributing phase, the controller maintains the level of water in the third chamber by measuring the pressure and turning on or off the transport pump 218 and/or water flow into the third chamber. The larger volume of the third chamber allows for some variation in water volume in the third chamber as the level is maintained. In this way larger dosages of liquid chemicals may be distributed to a desired device 102 (FIG. 1). As described above, the water that follows the chemical(s) to the device has the added advantage of flushing the chemical distribution system of the chemical(s).

To dispense a powdered chemical, a known dose of powdered chemical 204 and water 202 is introduced into top of the third chamber 206. The water and powdered chemical mix is then distributed to a desired device 102 (FIG. 1). An advantage of this system is that the powdered chemicals may be distributed to each device along the same single line as the liquid chemicals. This may be accomplished by, for example, turning on one of the transport pumps 218. More water may then be injected into the third chamber 206 to flush the chemical distribution system of the chemical.

The above described chemical distribution system and method allows the controller 214 to accurately dispense a desired dose of powdered and/or liquid chemicals to a ware wash or laundry washer along a single tube or line 116.

Figure 3:
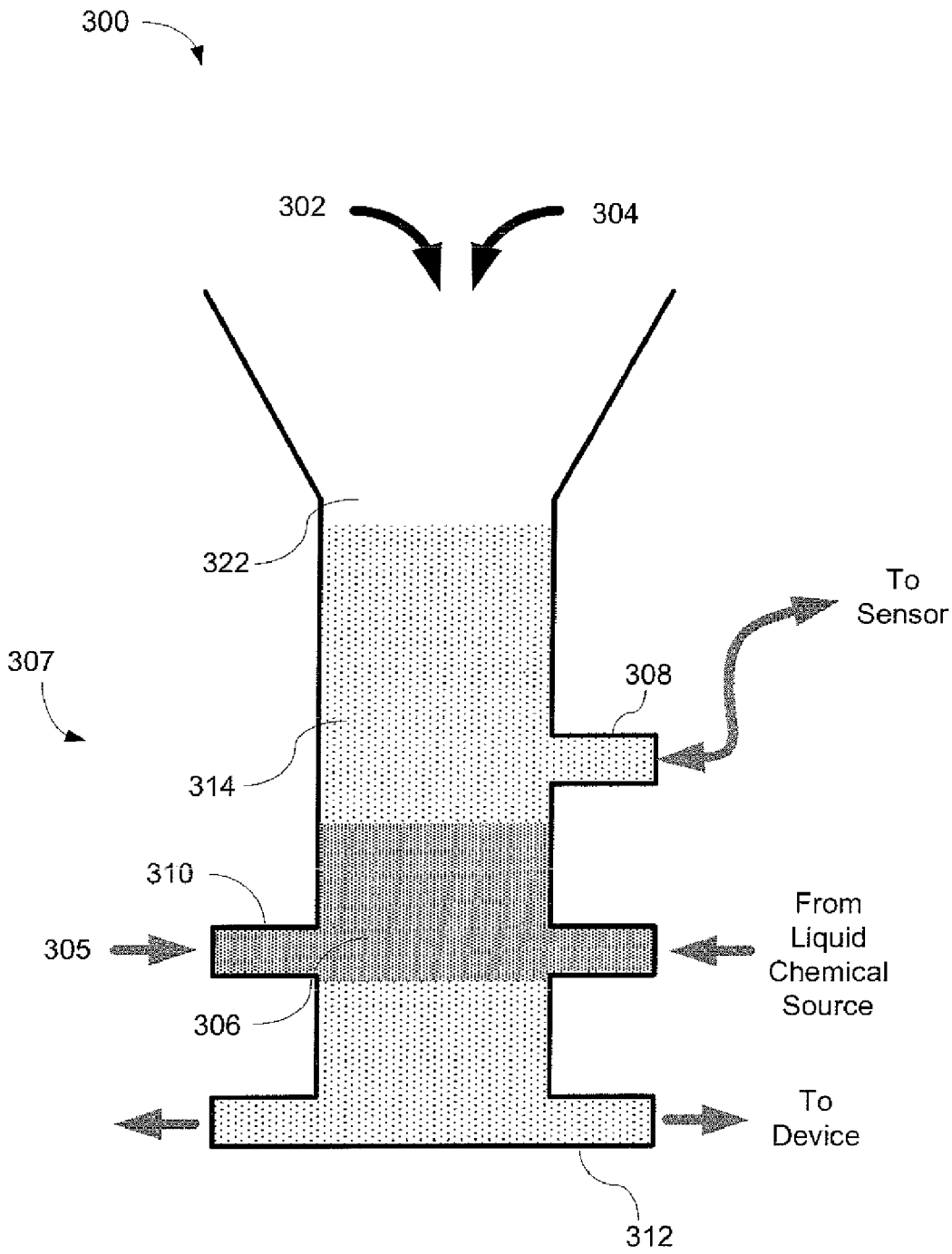
FIG. 3 is a partial cross-sectional view of another chemical distribution hub, according to another embodiment of the invention.

FIG. 3 is a partial cross-sectional view of another chemical distribution hub 300. Chemical distribution hub 300 is configured to receive water 302, one or more powdered chemicals 304, and one or more liquid chemicals 305. Unlike the hub 104 shown in FIG. 2, the hub 300 includes only a single chamber 307. The chamber 307 is defined by at least one chamber wall. In some embodiments the chamber wall is a circular wall that defines a cylinder having a predetermined diameter D. The volume of the chamber is selected such that any change in fluid level in the chamber is great enough to allow easy sensing of the change in pressure by a sensor, while retaining the water volume low enough to allow rapid flushing at the end of a dose cycle. A port 308 is formed in the chamber wall that allows fluid communication into the chamber. The port 308 is coupled to a sensor. In some embodiments, the sensor is a pressure sensor, such as an absolute pressure sensor, that measures the head of fluid above the port 308. In some embodiments, the sensor 236 (FIG. 2) is disposed within a controller (not shown), which calibrates the chemical distribution system, controls the flow of water and chemicals into the hub, and controls the flow of water and chemicals to the various devices 102 (FIG. 1).

The chamber 307 also includes one or more liquid chemical inlets 310 in the chamber wall below the port 308, and one or more outlets 312 that are each configured to be coupled to a different device 102 (FIG. 1). In use, liquid chemicals 306 are introduced into the chamber through the chemical inlets 310, and powdered chemicals 304 are introduced into the chamber through the top of the chamber 322. The water and chemicals are distributed to the devices through the outlets 312. Calibration, dosage, measurement, distribution and other control occurs in a similar manner to that described above in relation to FIG. 2.

Figure 4:
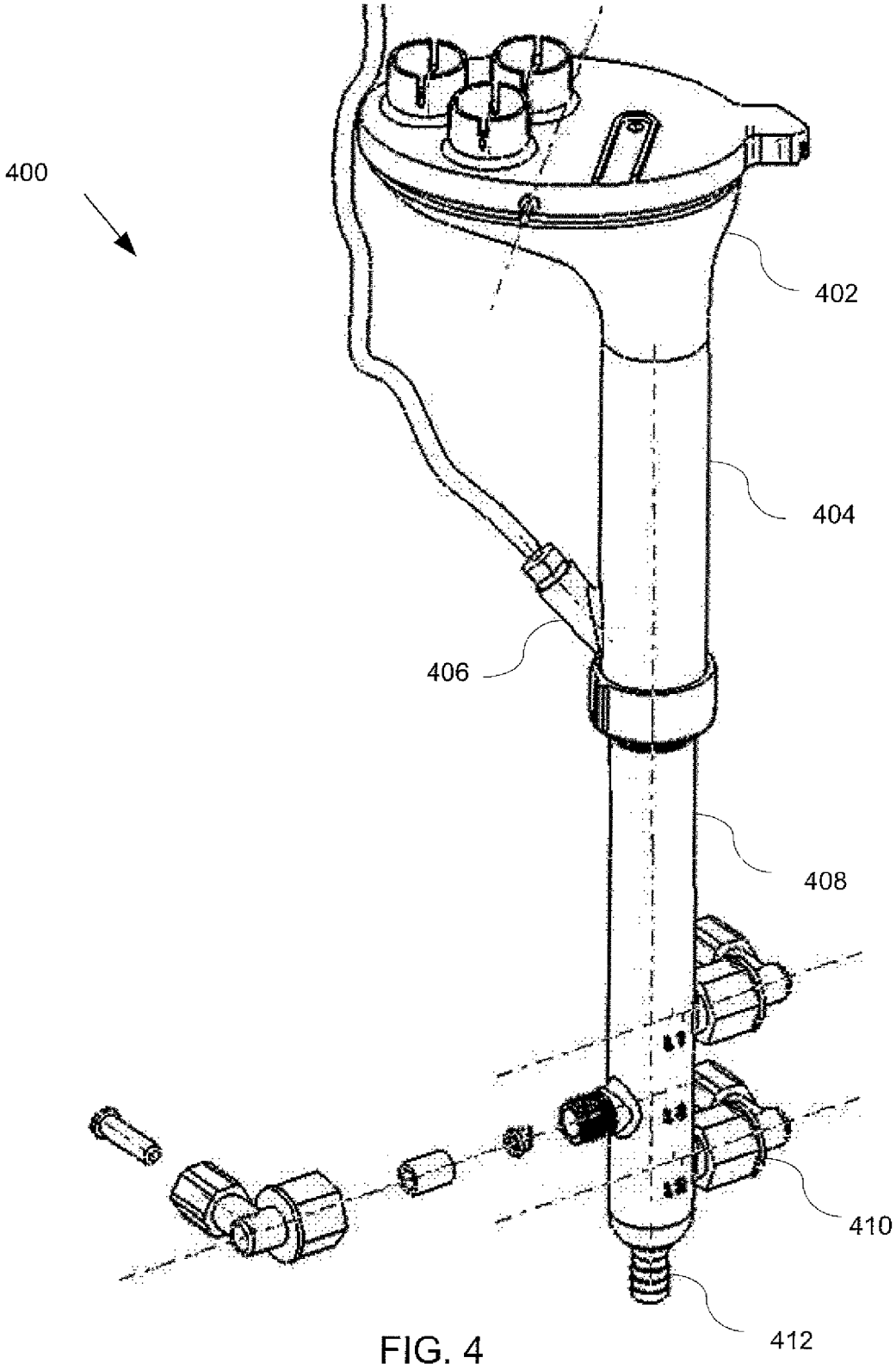
FIG. 4 is a perspective view of the chambers component of a chemical distribution hub, according to another embodiment of the invention.

FIG. 4 is a perspective view of the chambers component of a chemical distribution hub 400, according to another embodiment of the invention. The hub 400 includes many of the same components as described above in relation to FIG. 2. For example, hub 4 includes a first chamber 404 that is similar to the first chamber 208 (FIG. 2), a second chamber 408 that is similar to the second chamber 210 (FIG. 2), a third chamber 402 that is similar to the third chamber 206 (FIG. 2), three chemical inlets 410 that are similar to the chemical inlets 230 (FIG. 2), and a port 406 coupled to a sensor that is similar to the port 228 (FIG. 2). In some embodiments, the port 406 is disposed at an acute angle to the first chamber wall so that the port drains as the water level drops during flushing of water and chemical(s) to the devices 102 (FIG. 1). Although each of the first, second, and third chambers are shown in FIG. 2 as having stepped boundaries, in this embodiment the boundaries between chambers are graduated, e.g., the diameters of the chambers change gradually so that fluid easily drains from the chambers and there is no powder build-up. The hub 400 also includes an outlet port 412 that is coupled to a manifold via tube or line, as shown and described in relation to FIG. 6. A suitable range of diameters for the outlet port 412 is ⅛ to 1 inches.

Figure 5:
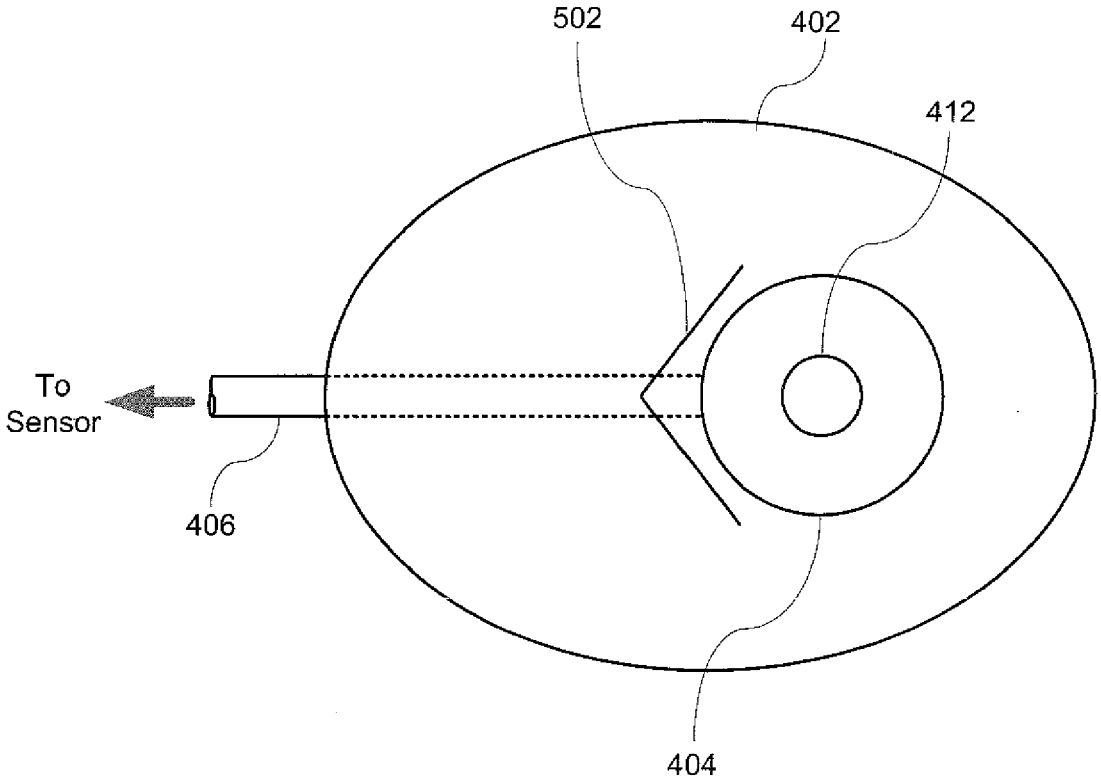
FIG. 5 is a top view looking into the third chamber of FIG. 4.

FIG. 5 is a top view looking into the third chamber 402 of FIG. 4. To prevent false readings of the sensor that may occur when water or chemicals entering the first chamber 402 pass directly over the port 406, a baffle 502 is positioned in the first chamber 402 above the port 406. The baffle 502 may be coupled to the wall of the first chamber. In some embodiments, the baffle 502 is formed in an angled shape to deflect water and chemicals away from the port 406. The baffle 502 may be formed from the same material as the first, second, and third chambers, and in some embodiments may be injection molded together as a single piece together with the first, second, and third chambers, port, and chemical inlets.

Figure 6:
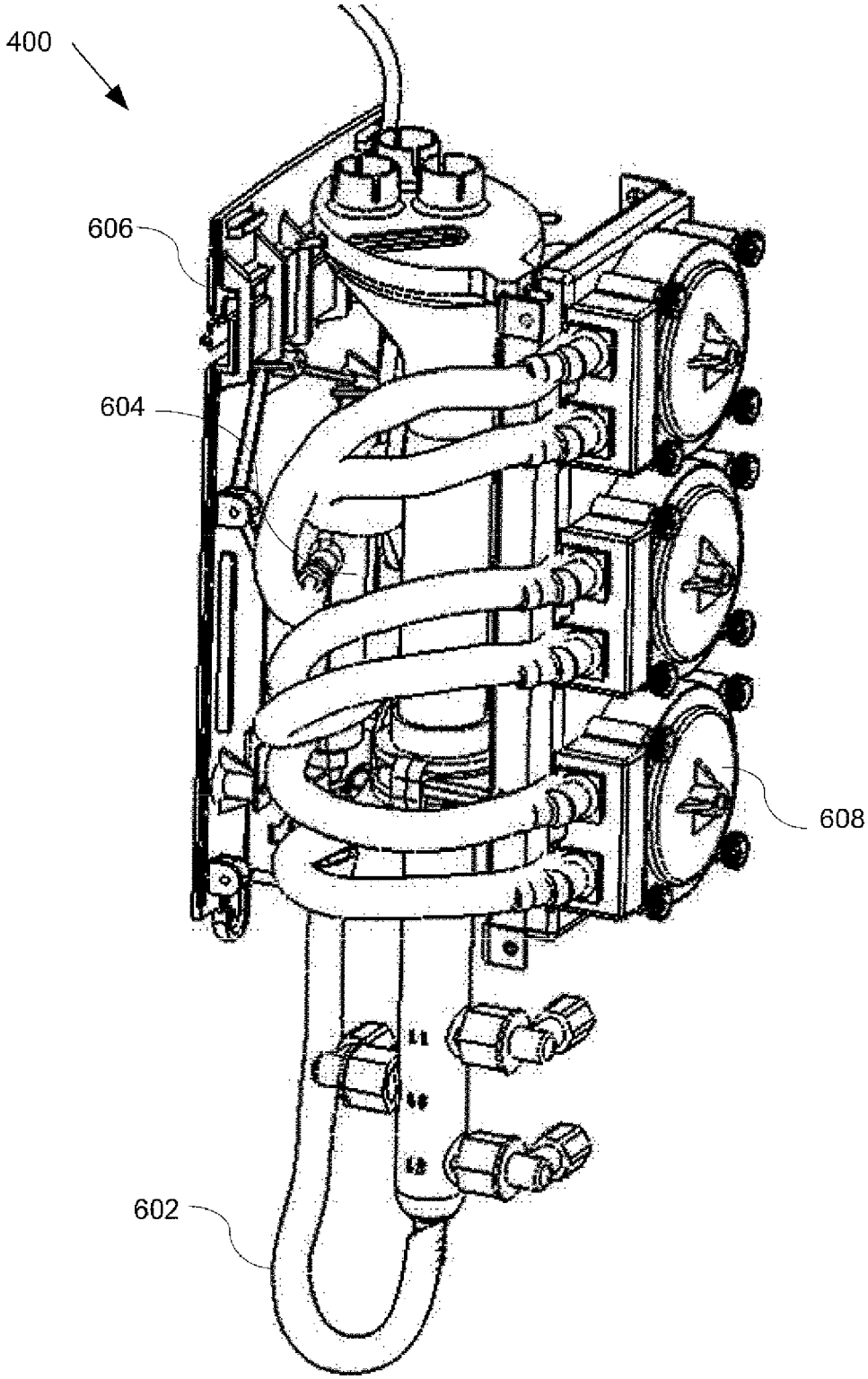
FIG. 6 is a perspective view of additional components of the hub shown in FIG. 4.

FIG. 6 is a perspective view of additional components of the hub 400 shown in FIG. 4. This view of the hub 400 includes the chambers shown in FIG. 4. The outlet 412 is fluidly coupled to a manifold 604 via a flexible tube or pipe 602. The three outlets from the manifold are in turn fluidly coupled to three separate transport pumps 608 via flexible tubes or lines. In some embodiments, the transport pumps are peristaltic pumps. Each of the flexible tubes or lines exiting the manifold is configured to be fluidly coupled to a separate device, such as a washer. In some embodiments, the chambers, manifold 604, and pumps 608 are coupled to a mounting plate 606 to allow the hub 400 to be wall mounted. The hub 400 may also house the controller 214 (FIG. 2). A housing (not shown) may connect to the mounting plate 606 to enclose the above described components.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. For example, it should be appreciated that while the above described systems and methods are directed to dispensing and distributing chemicals to washers, such as fabric washers or dishwashers, the above described systems and method may be used equally well to dispense and distribute chemicals to any other suitable devices or applications, such as water conditioners, swimming pools, etc. The presently disclosed embodiments are therefore to be considered in all respects as illustrative and not restrictive, the scope of the invention being indicated by the appended claims, and not limited to the foregoing description.

What is claimed is:

1. A powdered and liquid chemical distribution system, comprising:

a first chamber defined by at least one first chamber wall, the first chamber comprising:

a first chamber first end configured to receive water and one or more powdered chemicals into the first chamber;

a first chamber second end opposite the first chamber first end; and a port in the at least one first chamber wall, where the port is configured to be coupled to a sensor;

a second chamber defined by at least one second chamber wall, the second chamber comprising:

a second chamber first end fluidly coupled to the first chamber second end to receive the water and the one or more powdered chemicals from the first chamber;

a second chamber second end opposite the second chamber first end; and one or more liquid chemical inlets in the at least one second chamber wall, where each of the liquid chemical inlets is configured to be coupled to a different liquid chemical source; and a manifold comprising:

a manifold inlet fluidly coupled to the second chamber second end; and one or more manifold outlets each configured to be coupled to a different device.

2. The chemical distribution system of claim 1, further comprising a third chamber defined by at least one third chamber wall, the third chamber comprising:

a third chamber first end that is configured to receive the water from at least one water source and the at least one powdered chemical from at least one powdered chemical source into the third chamber; and a third chamber second end opposite the third chamber first end, where the third chamber second end is fluidly coupled to the first chamber first end.

3. The chemical distribution system of claim 2, wherein the third chamber has a volume larger than the first chamber, and the first chamber has a volume larger than the second chamber.

4. The chemical distribution system of claim 2, wherein the system is arranged during use to allow fluid to flow under a gravitational force from the third chamber first side toward the second chamber second side.

5. The chemical distribution system of claim 1, wherein the first chamber has a volume larger than the second chamber.

6. The chemical distribution system of claim 1, wherein the system is arranged during use to allow fluid to flow under a gravitational force from the first chamber first side toward the second chamber second side.

7. The chemical distribution system of claim 1, where the sensor is a pressure sensor used to determine the level of fluid in the first chamber.

8. The chemical distribution system of claim 7, where the level is the head of fluid above the port.

9. The chemical distribution system of claim 1, further comprising a liquid chemical pump coupled between each liquid chemical source and each liquid chemical inlet.

10. The chemical distribution system of claim 1, wherein the at least one liquid chemical inlet comprises at least two liquid chemical inlets each configured to be fluidly coupled to a different liquid chemical source via a different pump.

11. The chemical distribution system of claim 1, wherein the at least one manifold outlet comprises at least two manifold outlets each coupled to a washer via a different washer pump.

12. A chemical distribution system, comprising:

a first chamber defined by at least one first chamber wall, the first chamber comprising:

a first chamber first end configured to receive water into the first chamber;

a first chamber second end opposite the first chamber first end; and a port in the at least one first chamber wall, where the port is configured to be coupled to a sensor;

a second chamber defined by at least one second chamber wall, the second chamber comprising:

a second chamber first end fluidly coupled to the first chamber second end to receive water from the first chamber;

a second chamber second end opposite the second chamber first end; and one or more chemical inlets in the at least one second chamber wall, where each of the chemical inlets is configured to be coupled to a different chemical source; and a manifold comprising:

a manifold inlet fluidly coupled to the second chamber second end; and one or more manifold outlets each configured to be coupled to a different device.

13. The chemical distribution system of claim 12, further comprising a third chamber defined by at least one third chamber wall, the third chamber comprising:

a third chamber first end that is configured to receive the water from at least one water source into the third chamber; and a third chamber second end opposite the third chamber first end, where the third chamber second end is fluidly coupled to the first chamber first end.

14. The chemical distribution system of claim 13, wherein the third chamber has a volume larger than the first chamber, and the first chamber has a volume larger than the second chamber.

15. The chemical distribution system of claim 13, wherein the system is arranged during use to allow fluid to flow under a gravitational force from the third chamber first side toward the second chamber second side.

16. The chemical distribution system of claim 12, wherein the first chamber has a volume larger than the second chamber.

17. The chemical distribution system of claim 12, wherein the system is arranged during use to allow fluid to flow under a gravitational force from the first chamber first side toward the second chamber second side.

18. The chemical distribution system of claim 12, where the sensor is a pressure sensor used to determine the level of fluid in the first chamber.

19. The chemical distribution system of claim 18, where the level is the head of fluid above the port.

20. The chemical distribution system of claim 12, wherein the at least one manifold outlet comprises at least two manifold outlets each coupled to a washer via a different washer pump.

* * * * *